US010913168B1

(12) United States Patent
Salvitti

(10) Patent No.: US 10,913,168 B1
(45) Date of Patent: Feb. 9, 2021

(54) SELF-RETAINING INVERTED GRIP KNIFE

(71) Applicant: Alfred W. Salvitti, Glen Riddle, PA (US)

(72) Inventor: Alfred W. Salvitti, Glen Riddle, PA (US)

( * ) Notice: Subject to any disclaimer, the term of this patent is extended or adjusted under 35 U.S.C. 154(b) by 0 days.

(21) Appl. No.: 15/932,765

(22) Filed: Apr. 23, 2018

Related U.S. Application Data

(60) Provisional application No. 62/602,394, filed on Apr. 21, 2017.

(51) Int. Cl.

| | |
|---|---|
| ***B26B 1/10*** | (2006.01) |
| ***B26B 1/04*** | (2006.01) |
| ***B25G 1/10*** | (2006.01) |
| ***F41B 13/00*** | (2006.01) |
| *B26B 9/00* | (2006.01) |

(52) U.S. Cl.
CPC ..... *B26B 1/10* (2013.01); *B25G 1/102* (2013.01); *B26B 1/04* (2013.01); *B26B 9/00* (2013.01); *F41B 13/00* (2013.01)

(58) Field of Classification Search
CPC ..... B26B 1/02; B26B 27/007; B26B 1/04; B26B 1/10; B26B 9/00; B26B 3/00; B26B 21/527; B25G 1/102; F41B 13/08
USPC ..... D7/649–652; 30/298
See application file for complete search history.

(56) References Cited

U.S. PATENT DOCUMENTS

D51,772 S * 2/1918 Berkshire ..... D7/649
D137,451 S * 3/1944 Hardstad ..... D22/118
D137,916 S * 5/1944 Mrazek ..... 30/295
2,389,882 A * 11/1945 Wood, Jr. ..... F41B 13/08 30/151
2,520,355 A * 8/1950 Bell ..... B25G 1/102 16/430
D257,056 S 9/1980 Spivey
4,283,854 A * 8/1981 Austin ..... B26B 3/06 16/430
4,730,394 A * 3/1988 Sonner, Jr. ..... B26B 1/048 30/155
D297,105 S * 8/1988 Hollinshead ..... D8/98
D330,405 S * 10/1992 Luchak ..... D22/118
D362,485 S * 9/1995 Hall ..... D22/118
D383,519 S * 9/1997 Lainhart ..... D22/118
D392,016 S 3/1998 Balolia
(Continued)

OTHER PUBLICATIONS http://www.recoil.web.com/history-and-evolution-of-the-karambit-116156.html.*
http:www.guns.com/news2015/09/03/3-pistol-retention-must-haves-for-survival-edged-weapons.html.*

*Primary Examiner* — Laura M Lee
(74) *Attorney, Agent, or Firm* — Michael Best & Friedrich LLP

(57) ABSTRACT

A special purpose-designed combat knife to provide for passive retention of the knife without having the gripping hand fully closed. The essence of the disclosure is a handle which allows for passive retention in the user's hand. The knife uses a finger slot shape which allows retention of the handle without closing the user's hand around the handle of the knife. The user of the knife can also operate a handgun or other instrument in the same hand with the palm of the user relaxed about the handle without dropping the knife. A preferred embodiment includes a blade which protrudes from the lower end of the knife handle. An alternate embodiment includes a folding blade and locking design in which the knife blade protrudes from the top end of the handle.

4 Claims, 3 Drawing Sheets

(56) References Cited

U.S. PATENT DOCUMENTS

D464,551 S * 10/2002 Glesser ..... D22/118
6,658,743 B2 12/2003 Dudley et al.
D495,395 S * 8/2004 Rae ..... D22/118
D495,772 S * 9/2004 Hibben ..... D22/118
D502,526 S * 3/2005 Rae ..... D22/118
D545,163 S * 6/2007 Russell ..... D8/98
7,231,718 B2 * 6/2007 Outen ..... B26B 1/046 30/155
D569,474 S * 5/2008 Ubelander ..... D22/118
7,503,829 B2 * 3/2009 Cory, Jr. ..... F41B 15/08 206/37.1
D600,506 S * 9/2009 Miltner ..... D7/649
D607,529 S * 1/2010 Craffey ..... D22/118
D636,248 S * 4/2011 Still ..... D8/98
7,940,510 B2 * 5/2011 Krudo ..... B26B 11/00 361/232
D671,185 S * 11/2012 Ryan ..... D22/118
D697,577 S * 1/2014 Thompson ..... D22/118
D701,093 S * 3/2014 Follmer ..... D7/649
8,726,522 B2 5/2014 Lin
D713,923 S * 9/2014 Salvitti ..... D22/118
9,242,383 B2 * 1/2016 Drai ..... B26B 1/044
D768,803 S * 10/2016 Benton ..... D22/118
D780,877 S * 3/2017 Goeckel ..... D22/118
9,631,892 B1 * 4/2017 Salvitti ..... F41B 13/08
D801,469 S * 10/2017 Mandeville ..... D22/118
2003/0032386 A1 * 2/2003 Hendrickson ..... B26B 1/046 452/132
2006/0042098 A1 * 3/2006 Morales ..... B26B 3/00 30/298
2009/0313765 A1 * 12/2009 Krudo ..... B26B 1/044 7/158
2015/0151426 A1 * 6/2015 Hunkele ..... B26B 3/03 30/314
2015/0224652 A1 * 8/2015 Irvin ..... B26B 3/00 30/155
2016/0097614 A1 * 4/2016 Manly ..... F41G 11/001
2018/0154531 A1 * 6/2018 Caswell ..... B26B 1/00

* cited by examiner

SELF-RETAINING INVERTED GRIP KNIFE

CROSS REFERENCE TO RELATED APPLICATIONS

This application claims the benefit of Applicant's provisional patent application Ser. No. 62/602,394 filed Apr. 21, 2017, entitled self-retaining inverted grip combat knife.

BACKGROUND OF THE INVENTION

Field of the Invention

The present invention relates to combat knives with a self-retaining knife handle that allows the user to retain the knife with an open palm so that other tools and weapons can be used without discarding or removing the knife from the user's hand. In the preferred embodiment, a knife blade extends from the bottom of the handle as opposed to the top of the handle in conventional edged weapons.

Related Background Art

The use of knives or other edged or blade instruments are commonly used as a fighting weapon for self defense, military use or application by special services soldiers. Edged weapons are older than most fighting weapons and predates the age of firearms. Most edged weapons are comprised of relatively straight blades whose handle is part of a single tang which is used in the formation or construction of the edged weapons. A handle for a single or double edged fighting blade is typically inline with the tip of the blade being coaxial with the center line of the blade itself. However, these traditionally styled or shaped fighting blades require the user to grasp the blade such that in a normal, comfortable stance, the blade will be pointed either up or down as a user extends his or her arm forward with the user's hand clasping the knife handle in a conventional position and naturally extended first pointed in line with the arm and wrist.

Many people are familiar with pointing a pistol or certain types of rifles or other firearms that use a pistol grip. The grip is typically angled away from the center line of the firing end of the firearm which projects the bullet towards the intended target. For many people who have been trained with firearms for self defense or military use, it is a normal and natural progression to point a pistol or a rifle with a pistol grip at the intended target in a natural stance.

Knives and other edged weapons typically do not present this type of ergonomic situation to the user. Accordingly, it would be more natural for a user to have an edged weapon or a knife which presents a pistol grip-like handle such that the point of the weapon can be thrust forward toward the intended target while the user is maintaining a natural and comfortable grip, much like the grip of a small side arm or pistol that the user may already be comfortable in using.

More particularly, it would be desirable to design an edged fighting weapon which can be handled by the user in a manner or fashion simulating the drawing of, and thrusting forward of a pistol handgun so that muscle memory and training techniques will be familiar to the user. Many military training programs including special forces, law enforcement special operations and the SWAT teams, and self defense security training frequently spend considerable time on teaching the fundamentals of drawing a pistol from a side holster, bringing it up towards the chest and thrusting outward to point the weapon at the target. It would be useful to capitalize on such well known training techniques and translate those techniques to an effective use of an edged fighting weapon so that in high stress situations a trained user could rely on both pistol drawing and pointing and manual hand to hand combat techniques and apply them directly to the operation of an edged fighting weapon.

Most knives, whether a combat or fighting knife, a kitchen knife or other similar implement, have in common the same parts. Beginning at the farthest end of the knife from what would be considered a handle, the tip of the knife is the forward part of the knife and includes the knife point. While the tip is used for detailed or delicate cutting, the knife point is a part of the knife where the edge and the spine come together and is used for piercing such as in a forward thrusting action when using the knife. The edge of a knife is the cutting part of the blade and typically extends from the point to the heel of the knife. The heel is the rear part of the edge opposite the point discussed above.

Some knives can have an area called the spine which is the top of the knife blade opposite the knife's sharp edge. However, many combat or defensive knives, such as in the present invention, have an edge added to both sides of the blade extending from the point all the way to the heel. The bolster of a knife is the band that joins the blade of the knife to its handle. A bolster can provide balance to the knife and also helps protect the hand from getting in the way of the knife's edge by limiting travel of the hand sliding forward when it is grasping the handle.

The tang is the part of the blade that extends into the handle of the knife. The tang is typically the surface to which the handle attaches to the blade that allows a comfortable grip. Quality knives of better design have a single tang in which the tang is actually the same piece of steel or other metal used to fabricate the entire knife from point to butt. The butt is the end of the handle of the knife at the opposite location on the knife from the point. Some knives have scales which are the part of the knife that creates a comfortable handle wrapped about the tang.

Scales sometimes are made of synthetic material or wood as one might see in a traditional knife. Two scales are typically attached to the tang with rivets on either side to create a grip around the handle. Some knives forego separate scales and fashion the tang to have an integrated handle allowing a firm grip. Some knives incorporate a cross guard or hand guide to protect the fingers holding the knife in a hand.

The one problem which has yet to be address by knife designers is retention of a combat knife in a dynamic situation where the user needs to transition from a knife to a firearm, such as a pistol. In contemporary practice, a soldier may need to discard a combat knife during a tactical encounter so as to handle a pistol or other weapon. This is because holding both weapons at once in the same hand is impractical. What is needed is an edged weapon which can be passively retained by a user without the need to focus on a hand grip of the weapon as the user transitions to a pistol, for example. Being able to retain the edged weapon on the hand while another device is placed in the hand is a useful tactical advantage. No simple solution presently exists to provide for this advantage.

The many different styles of edged weapons and fighting knives do not yield or demonstrate an edged fighting weapon which will allow a user to more readily learn self defense tactics or military techniques in using edged weapons that are similar to any experience that user has with a firearm. What is needed is a new design in an edged weapon to allow the application of a more natural pointing and thrusting instinct of the user such that the user may be taught more quickly and more effectively to use an edged weapon in very close quarters combat. Moreover, a new pistol-grip design which further provides for passive retention of the knife is needed to satisfy new commando close quarters fighting techniques.

SUMMARY OF THE INVENTION

The disclosed invention provides an edged fighting weapon with an integral pistol grip to allow the user to more comfortably handle the edged weapon as it is thrust forward in the use as a combat device or self defense weapon. The knife disclosed is most readily deployed as a thrusting weapon effective for military tactics and self defense taught to military operatives and other special trainees.

In the improvements disclosed, the grip of the knife is also formed to provide for retention of the knife in the hand of the user without griping the knife handle in the usual fashion. Rather, the knife handle provides for the pinky finger and the ring finger of the user to tightly engage in a keyhole-like finger opening in the grip such as to wedge the grip in the hand. The user's pinky finger engages a smaller segment of the slot while the index finger engages a larger opening area in the slot thereby providing for tighter fitting compression while remaining comfortable for the user. Without closing the user's grip, the knife can be easily retained in the hand while the hand is also holding another tool, flashlight or firearm such as a handgun. The design disclosed allows the knife to be retained in the user's palm without gripping the handle by wrapping fingers around it tightly in the conventional fashion. The various embodiments of the invention provides for a blade protruding from either the top or the bottom of the handle in substantially a 90° angle when measured from the axis of the handle running from the top to the bottom of the handle. In each embodiment, the handle functions in the same fashion to facilitate retention of the handle without closing a user's grip about the handle as would be otherwise required to retain a conventional knife in the user's hand.

It is therefore the object of the present invention to provide a design for an improved combat and fighting knife which is easily retained in the user's hand without the need to close the user's hand around the handle.

It is further the object of the present invention to provide a knife design specifically for combat fighting whereby the user can hold the knife in a ready position while also holding a pistol in the same hand.

It is yet another object of the present invention to provide an improved method of retaining an edged weapon in the user's hand without the need to focus on a tight grip of the knife handle.

It is also the object of the present invention to provide a knife designed to stay in a user's hand while the user is opening or closing the user's hand grip around the knife's handle by tightly fitting the handle among the fingers of the user thereby allowing retention of the knife while manipulating another object in the same hand, such as a firearm, flashlight or other object.

It is also an object of the present invention to provide a knife designed to stay in a user's hand while the user is opening or closing the user's hand grip around the knife's handle by tightly fitting the handle among the fingers of the user while also providing a knife blade which protrudes outwardly from the bottom of the handle when held in the user's hand.

Is also the object of the present invention to provide a self retaining pistol grip combat knife in which the blade may be stored within the handle by reverse rotation of the blade such as to allow storage of the blade within the handle without blocking the handle undulations used to facilitate the grip of the handle.

DETAILED DESCRIPTION OF THE INVENTION

Figure 1:
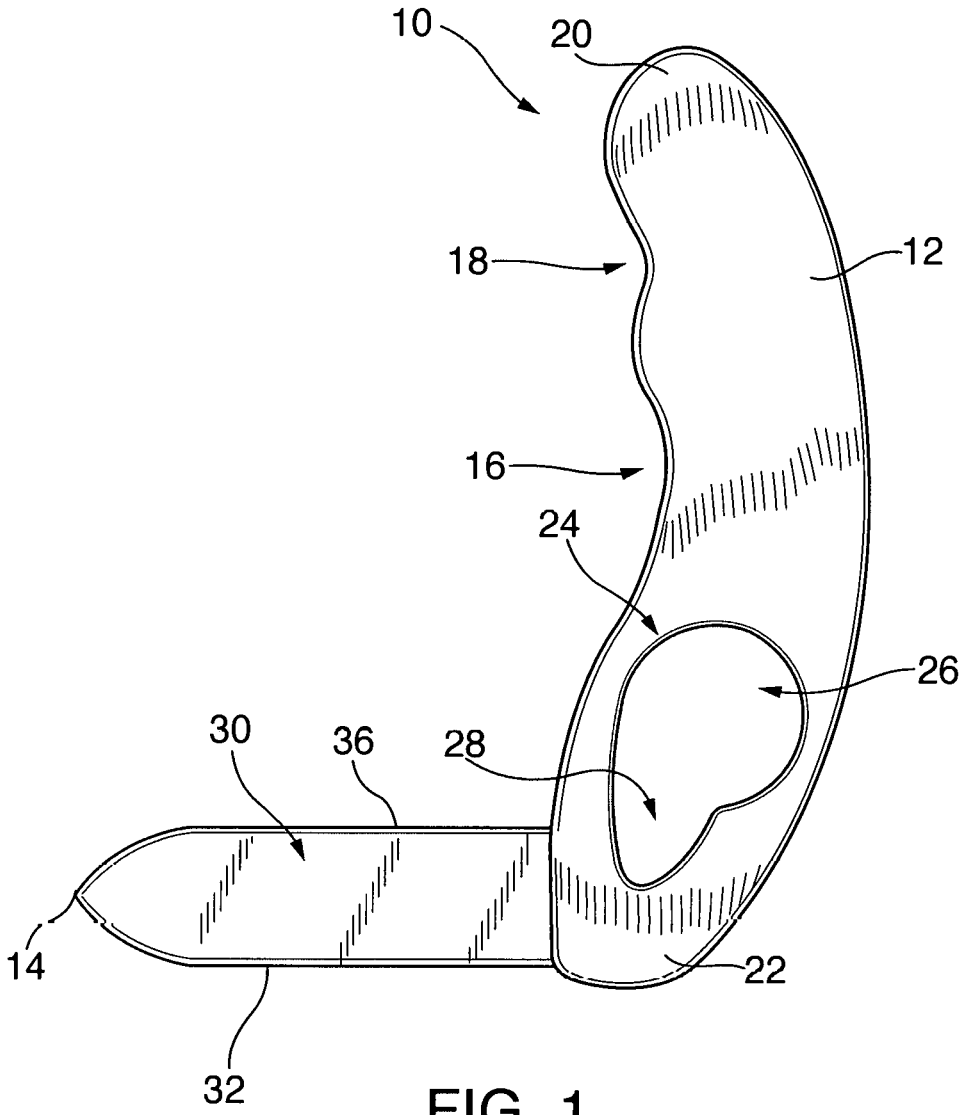
FIG. 1 is a side view of the invention in its preferred embodiment with the knife blade protruding from the bottom end of the knife handle.

And now the invention will be described in detail with reference to the various Figures as numbered to describe constituent parts of the invention. Like numbers refer to like parts in the drawings.

Figure 4:
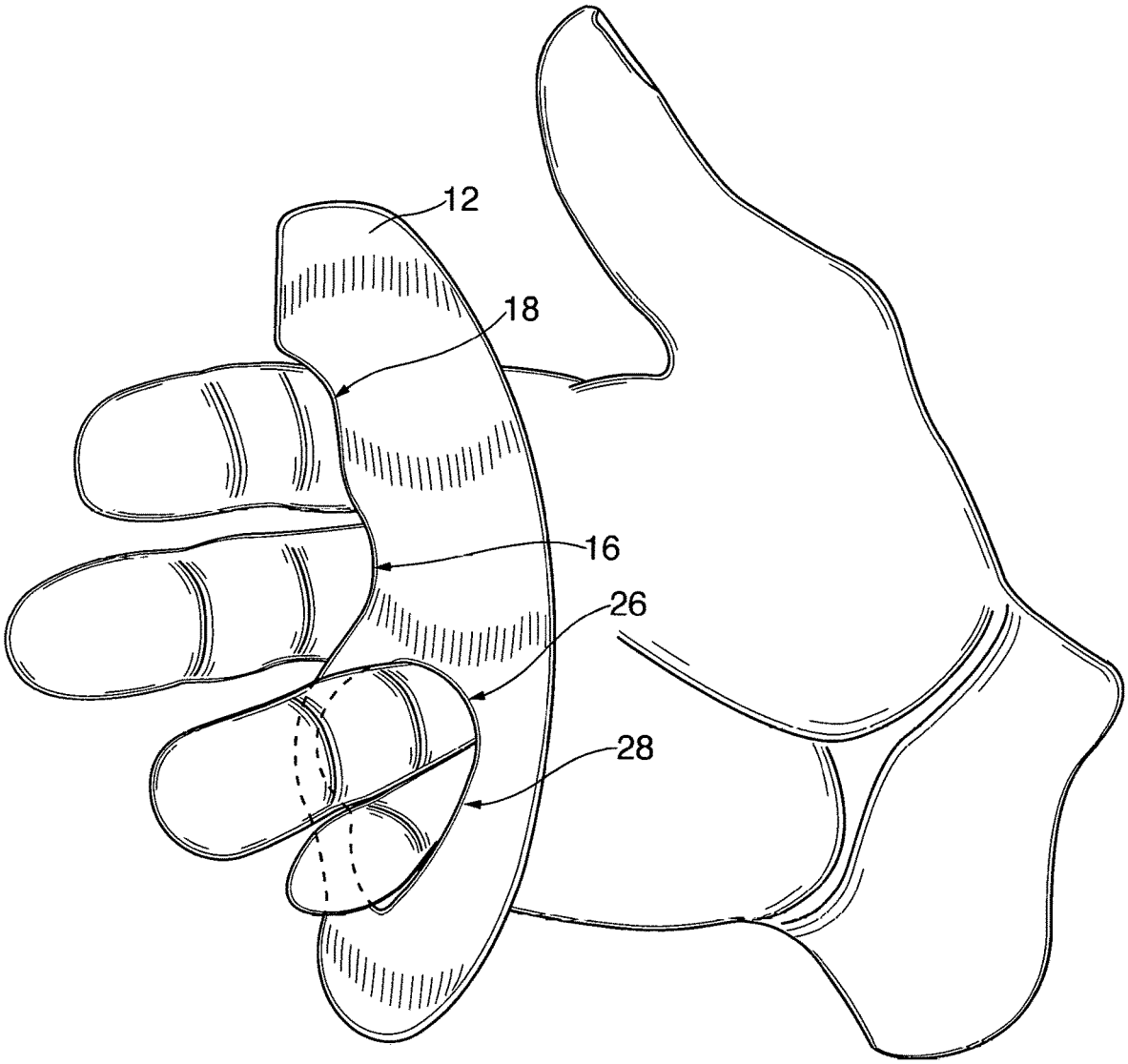
FIG. 4 is a pictorial diagram of the invention handle in a human hand without a blade to illustrate the relationship of the knife handle, the finger slots at the ring finger position and pinky finger position on the handle and the finger grip undulations.

Turning to FIG. 1, a basic embodiment of the enhanced retention combat knife 10 is disclosed. The essence of the invention is the geometry of knife grip 12 which is designed to provide retention of the grip while placed in a user's hand without the user's hand being closed or clasped around the handle in a conventional fashion. The common names for the fingers of the human hand, beginning with the shortest baby finger or "pinky" finger, includes ring finger, middle finger and index finger. The thumb on the human hand is typically not referred to as a finger, but for the purpose of the present invention, the thumb is not used for retaining the knife handle when the user's palm is open. Of each finger, there are three segments. The outermost segment of a finger is referred to as a distal phalanx, the middle segment is the middle phalanx and the inner segment is proximal phalanx. The handle of the knife as disclosed fits best and most securely when the pinky and ring finger is inserted in finger slot 24 and handle 12 rests on the proximal phalanx as shown in FIG. 4.

As shown on FIG. 1, knife grip 12 is comprised of finger slot 24, itself comprised of ring finger position 26 and pinky finger position 28. Finger slot 24 provides the retention of knife handle 12 in the hand of the user without the need to wrap the user's fingers around handle 12. Upper knife handle undulations 18 for the index finger and lower knife handle undulations 16 for the middle finger allow all four fingers of the user to snugly engage the handle in a manner and fashion which provide for retention of the handle without the user's palm being clasped around the handle as would be necessary with a conventional knife or with a weapon such as a handgun. Use of finger slot 24 and the shape thereof is key to the slight compression of the ring finger and the pinky finger of the user in the inverted keyhole-like shape of slot 24 as can be appreciated in the various figures.

The invention in FIG. 1 shows the high retention combat knife in its simplest form which is comprised of handle 12 and blade 30 in its major elements. Blade 30 is comprised of blade point 14 and blade cutting edge 32 although it can be appreciated that blade 30 may have multiple edges depending on the design discretion of the blade. In the various figures blade 30 is comprised of lower cutting edge 32 and upper cutting edge 36.

Figure 3:
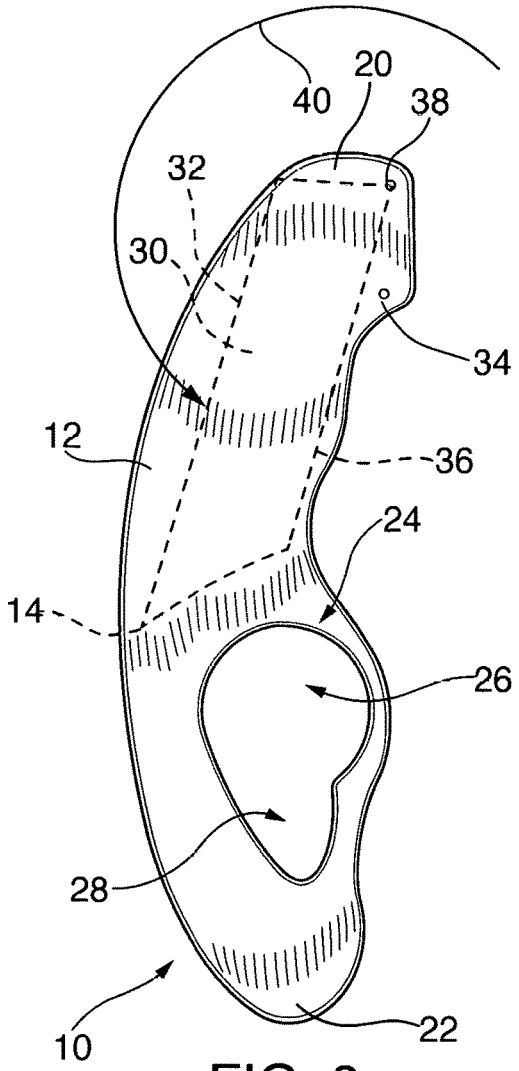
FIG. 3 is a side view of an alternate embodiment of the invention in FIG. 2 with a folding blade option illustrating a blade in the closed position within the handle.

In its simplest form, the knife in FIG. 1 is a one piece design and is not designed to fold given that blade 30 protrudes outwardly from handle bottom 22. The embodiment shown in FIG. 1 would not easily allow for a retracting or rotating blade to nest in handle 12. The blade would sweep into a position which both blocks slot 24 and may be a safety concern as well. However, as can be appreciated by the illustration in FIG. 3, blade 30 can be designed to fold into the handle 12 in which blade 30 is shown in ghosted view rotated into an interior slot built into handle 12. In this alternative embodiment in which blade 30 would be a folding knife blade, it would rotate counter clockwise in direction 40 to seat within the handle as shown in FIG. 3.

Figure 2:
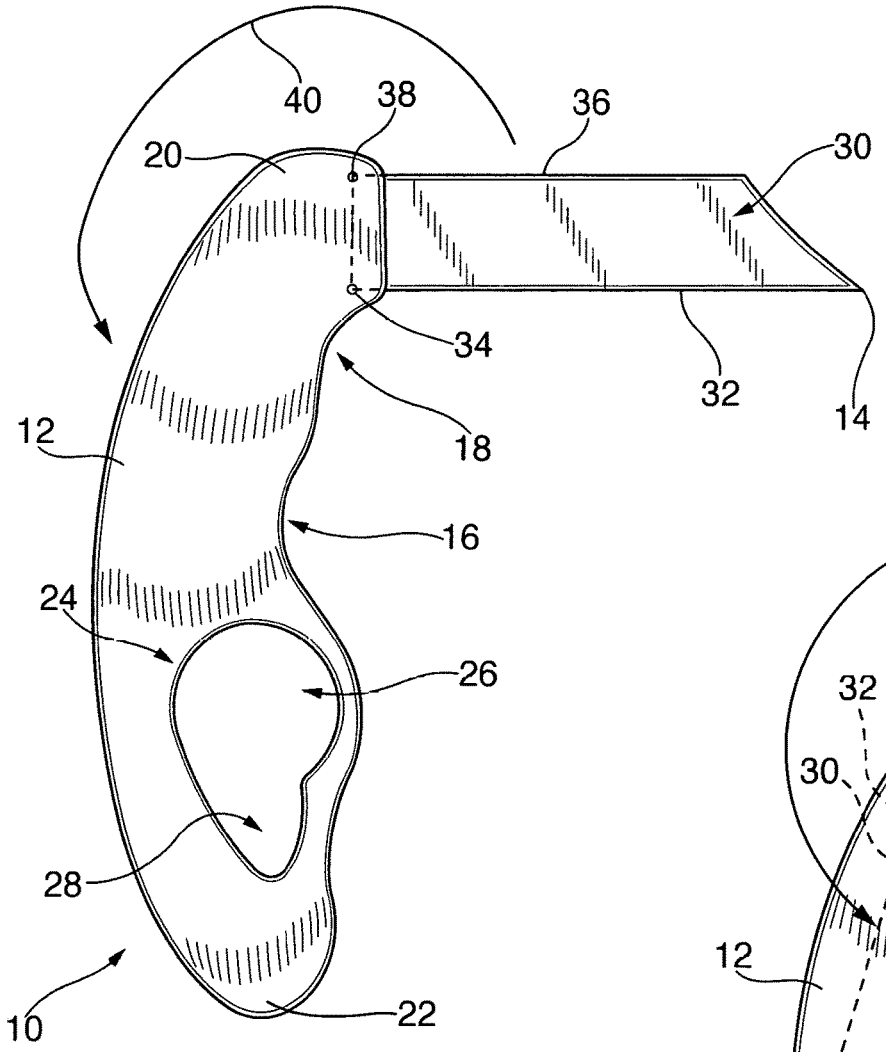
FIG. 2 is a side view of the knife shown in an alternative embodiment with the knife blade protruding from the top of the knife handle.

FIG. 2 shows the knife in the embodiment for which the blade is protruding from handle top 20. The blade, in this alternative, could also be configured to rotate around hinge 38 shown in the various figures as direction of rotation 40. When blade 30 is in the fully open position as shown in FIG. 1, the blade can lock in position either by having a detent device in hinge 38 or providing a lock of the blade at position 34 shown in the various figures.

Returning to FIG. 1, it can be seen that finger slot 24 is designed in an irregular oval pattern allowing a specific area for the pinky finger position 28 and the ring finger position 26 when the knife is grasped by the user. The user's index and middle fingers slide onto the handle undulations 16 and 18. Finger slot 24 is designed to tightly retain the user's ring and pinky fingers as shown in FIG. 4. The pinky finger and the ring finger of the user is snug in finger slot 24, thereby preventing handle 12 from sliding off the user's hand when the user's palm is opened. This specific design allows the handle to remain tightly affixed to the user's hand as shown in FIG. 4 without the user's fingers being curled around knife handle 12. Once the user's hand is inserted within the handle as shown in FIG. 4, handle 12 will remain in position regardless of whether the user is clasping the knife in a conventional style or has the user's hand and palm completely open such as shown in FIG. 4. As shown, the user's middle finger rests on the lower knife grip undulations 16. The user's index finger rests on the upper knife grip undulations 18.

In all variations of the invention, shown in FIG. 1 and FIG. 2, blade 30 extends from handle 12 in approximately a right angle, substantially 90°, from the axis of handle 12 defined as a line running from handle top 20 to handle bottom 22. The angle is not critical in that several degrees in either direction of a right angle would still carry out the same advantage of the present invention.

FIG. 4 illustrates how handle 12 allows retention regardless of the embodiment of the invention. Handle 12 functions similarly whether the blade is protruding from the top or the bottom of the handle. FIG. 4 demonstrates the specific positioning of the four fingers of the user and how the blade handle is retained without closing the user's hand around the handle. It should be noted that in FIG. 4, blade 30 is not shown attached to the handle for the purpose of having a clear illustration of how handle 12 is the essence of the present invention.

By locating finger slot 24 in its specific embodiment for the user's lower fingers as shown in FIG. 4, the knife is retained without tightening the user's fingers around the handle, thereby allowing the user's hand to also be manipulating another device. Another device can be a tool, or appropriately a handgun or other firearm. The advantage is that the user does not have to put the knife down to pick up a handgun with the same hand. Knife 10 may be placed on the user's hand and then retained while the user manipulates a handgun or other firearm without a concern that the knife placed in the hand first would slip, move or interfere with the operation of the handgun. Retention eliminates a need to reacquire the knife if the firearm is not functional for any reason or otherwise is inappropriate for the encounter. Knife 10 is already placed and is being held firmly by the user without the user needing to concentrate on his or her handling of the knife. This function is the advantage of the present knife and the essence of the present invention.

When handle 12 is fashioned as shown in the drawings, the knife is easily retained with an open palm even if the user engages in with a sharp motion of the hand. This advantage is useful in certain combat and stealth scenarios where the user desires to have the knife planted in the user's hand while still having a firearm also handled in the same hand. While the embodiments disclosed limit the finger slot to two fingers, it can be appreciated that elongation of finger slot 24 would allow use of three or more fingers to slip into a compressible fit in a similar fashion, thereby providing that the user of the knife wears the handle on the hand without closing the user's grip about the handle.

Although the invention has been described in accordance with the preferred embodiments, it will be appreciated by those skilled in the art that the application of the present invention is useful in a variety of configurations and designs not specifically described above. All such designs and applications are considered to be within the scope of the present disclosure, and the invention is applicable across a wide variety of applications. Such applications are considered within the scope and spirit of the present invention.

In as far as a description above and the accompanying drawings disclose any additional subject matter that is not within the scope of the claims below, the inventions are not dedicated to the public and the right to file other applications to claim any additional inventions is reserved.

What is claimed:

1. A knife comprising:

a handle for holding the knife, the handle having a first end and a second end opposite the first end, a distance from the first end to the second end defining a length of the handle, and the handle configured to be substantially flat with a first edge and a second edge extending from the first end to the second end, the first edge being generally opposite the second edge;

a blade connected to the first end of the handle, the blade including a cutting edge extending from the first edge of the handle in a direction generally perpendicular to the length of the handle;

undulations along the first edge of the handle, the first edge adjacent to the blade, wherein said undulations are configured to provide finger grips for a user's hand while holding the knife; and an opening in the handle configured to receive the user's pinky finger and ring finger and compress said fingers together to facilitate retention of the handle in the hand of the user;

wherein the undulations are closer to the first end than the opening is to the first end, and the opening is closer to the second end than the undulations are to the second end, and wherein the opening in the handle includes a wider portion to accommodate the ring finger and a narrower portion to accommodate the pinky finger, the narrower portion closer to the second end than the wider portion.

2. The knife of claim 1 wherein the handle is configured to have an interior space to allow storage of the blade;

wherein the blade is attached to the handle with a hinge to allow rotation of the blade; and wherein the blade further configured to rotate about the hinge toward a stored position in which the blade is received within the interior space in the handle for storage of the blade within the handle.

3. The knife of claim 2, wherein the blade is rotatable to the stored position through the second edge of the handle.

4. The knife of claim 1, wherein the blade is configured as a fixed blade.

* * * * *